US005178667A

United States Patent [19]

Kemori et al.

[11] Patent Number: 5,178,667

[45] Date of Patent: Jan. 12, 1993

[54] DRY PROCESS FOR REFINING ZINC SULFIDE CONCENTRATES

[75] Inventors: Nobumasa Kemori; Akihiko Akada; Hitoshi Takano; Takeshi Kusakabe; Masaru Takebayashi, all of Niihama, Japan

[73] Assignee: Sumitomo Metal Mining Company Limited, Tokyo, Japan

[21] Appl. No.: 767,894

[22] Filed: Sep. 30, 1991

[30] Foreign Application Priority Data

Oct. 9, 1990 [JP] Japan ..... 2-271654
May 28, 1991 [JP] Japan ..... 3-150875

[51] Int. Cl.[5] ..... C22B 19/04; C22B 13/00

[52] U.S. Cl. ..... 75/658; 75/696; 423/107; 423/108

[58] Field of Search ..... 75/655, 656, 658, 659, 75/694, 696, 695; 423/107, 108

[56] References Cited

U.S. PATENT DOCUMENTS 4,741,770 5/1988 Andrews et al. ..... 75/655

FOREIGN PATENT DOCUMENTS

WO87/03010 5/1987 PCT Int'l Appl. .
WO88/01654 3/1988 PCT Int'l Appl. .

*Primary Examiner*—Melvyn J. Andrews
*Attorney, Agent, or Firm*—Foley & Lardner

[57] ABSTRACT

A pyrometallurgical refining process for obtaining one or both of zinc and lead from a sulfide concentrate, in which an iron-silicate slag or iron-silicate slag containing lime is formed and the sulfide concentrate, incombustible materials, and flux, together with at least one of industrial oxygen, oxygen-enriched air, or air, are blown into the slag to cause a reaction; as a result of the reaction, the major part of the zinc and part of the lead in the sulfide concentrate and the incombustible materials are dissolved in the slag, to arrange the slag and a matte and/or metal from one part of the lead in the raw material. A reducing agent such as heavy oil, pulverized coal, powdered coke, or the like is blown through the resulting slag, and the zinc and the lead in the slag are volatilized then condensed to obtain molten zinc and molten lead.

26 Claims, 3 Drawing Sheets

DRY PROCESS FOR REFINING ZINC SULFIDE CONCENTRATES

BACKGROUND OF THE INVENTION

1. Field of the Invention

The present invention relates to a process used to refine or smelt zinc sulfide concentrates.

2. Description of the Prior Art

Methods used to obtain zinc metal from zinc sulfide concentrates are broadly divided into hydrometallurgical processes and pyrometallurgical processes.

In both the hydrometallurgical processes and the pyrometallurgical processes for refining zinc, the zinc sulfide concentrates, which are the main raw materials, are first roasted to form zinc oxide. In the hydrometallurgical process, following the roasting the zinc is recovered by acid leaching or electrolytic recovery processes. In the pyrometallurgical process, following the roasting the zinc oxide is charged into a furnace with coke, and the like, and the zinc is recovered by reduction and volatilization.

Only electrolytic refining is used with the hydrometallurgical process, in actual practice. In the electrolytic refining process, the roasted ore obtained by roasting the sulfide ore is dissolved in sulfuric acid to obtain a zinc sulfate solution, then, after removing iron and the like by cleaning the solution, electrolytic zinc is obtained by electrolysis and melted in an electric furnace to obtain zinc metal. However, as moderate as possible a roasting process must be adopted with this process, therefore a fluidized roasting furnace is generally used. For this reason, a zinc concentrate with a high lead content cannot be used because such zinc concentrate is apt to be clustered to form briquettes, and in addition, when the resulting zinc oxide is leached, impurities such as copper, cobalt, nickel, cadmium, and the like are also leached out. Therefore, these impurities must be removed prior to the electrolytic recovery of the zinc.

Pyrometallurgical processes include a horizontal distillation process, a vertical distillation process, an electrothermal distillation process, and an ISP process.

In the horizontal distillation process, the roasted ore and 40 to 60 wt % coal for reducing are mixed together and this mixture is charged into a horizontal retort which is heated from the outide. The zinc is reduced and volatilized, then condensed in a condenser. The horizontal distillation process is a batch process and is therefore extremely labor intensive. The operating environment is also poor, and because this process also offers very few advantages of large scale or mass-production, it has been seldom used since the latter part of the 1970s.

In the vertical distillation process the roasted ore and the like with pulverized coal and powdered coke are kneaded together to form briquettes, which are heated in a carbonizing furnace for coking. The resulting briquettes are heated in a vertical type retort to which heat is supplied from the outside. The retort is fed and heated continuously, so that the zinc is reduced and volatilized from the briquettes, then condensed in a condenser provided on the upper section of the retort. The vertical distillation process utilizes the same principles as the horizontal distillation process, but, whereas the horizontal distillation process has the drawback of poor productivity, the vertical distillation process gives good results in this respect. However, because this process uses a vertical furnace with external heating, the maximum capacity of the furnace is 200 to 300 tons of zinc per month, and the process is highly complicated. It is also necessary to process briquette tails or slags containing copper and lead produced in the furnace, therefore this process is now no longer used to refine zinc.

In the electrothermal distillation process, the roasted ore is mixed with powdered coke and sintered to obtain a sintered ore. This sintered ore is fed into a cylindrical-type furnace and power is applied to vertical electrodes provided in the furnace to subject the mixed raw material to resistance heating in which the raw material itself acts as the resistance, so that the ore is reduced and distilled. The production capacity of the electrothermal distillation process is 1,000 to 3,000 tons of zinc per month, higher than the previously-described two processes. However, the pre-process to obtain the lumps of sintered material which are fed into the furnace is very time consuming. Because an electrically heated furnace is used there is the drawback that there is a limit to the reduction in the electric power consumption rate. Therefore, in regions where the cost of electrical power is high, this process is seldom used.

In the ISP process, the preprocessing comprises mixing the sulfide concentrate with a suitable amount of a solvent, forming a sintered oxide, and removing the sulfur to obtain lumps of sintered material. This sintered material mixed with coke is charged into a blast furnace, then heated and reduced in the blast furnace to volatilize the zinc. Molten lead is splashed through the zinc vapor and the zinc is captured in the form of a lead-zinc alloy. This alloy is then cooled and the zinc and lead solution are separated, utilizing the difference in zinc solubility, and rectified, if required, to obtain zinc metal. The ISP process has the special feature of simultaneous smelting of the zinc and the lead, and is the main pyrometallurgical process in present day use.

The ISP process has been widely adopted from among the pyrometallurgical processes because the productivity of the ISP process is high, it can provide simultaneous smelting of the zinc and the lead, and the allowable amount of impurities is high.

In the ISP process, zinc sulfide concentrates are roasted or sintered together with lead concentrates or zinc concentrates containing lead, to obtain a sintered ore with adequate strength. Technology has been developed and adopted for the ISP process by which even in an atmosphere rich in carbon dioxide gas which has a reoxidizing tendency, the gas containing zinc vapor can be processed at a high temperature of 1,000° C. or greater in a molten lead splash condenser to condense zinc. Accordingly, the production volume for one furnace is increased as high so 6,000 to 10,000 tons of zinc per month.

The ISP process can, in fact, be said to have many advantages in productivity, thermal efficiency, and raw material handling, but to obtain the sintered lumps to feed to the blast furnace, it is impossible to avoid the repeated recycling of powder in the roasting and sintering processes equivalent to about four times the ore. Furthermore, the operation of the above-mentioned roasting and sintering processes requires skill, and high priced lump coke are required for the blast furnace.

Furthermore, if the roasting temperature is set rather high to promote oxidation in the sulfur removal process which is a preprocess for the ISP process, part of the raw material melts, fuses and sticks to the roasting equipment, making it difficult to discharge the roasted material from this equipment. In the worst case, it becomes necessary to halt the process of whole operation. In addition, cohesion of the particles occurs because part of the raw material melts, and the surface area of the reacting particles decreases in size so that the roasting temperature must be reduced to below 1,100° C., which in turn decreases the rate of sulfur removal. Even at a roasting temperature of 1,100° C. or less, the equivalent of about four times the raw material fed into the roasting equipment must normally be recycled as returned powder to prevent cohesion of the particles. In addition, the problem occurs that when the roasting temperature is lowered, the effective utilization of the heat of oxidation produced in the desulfurizing reaction is not realized.

A report relating to a oxidizing reaction for zinc sulfide appears in Metallurgical Transactions B (Voume 21B; October 1990; pp. 867 to 872). In this process, the ZnS is first embedded in slag and reacts with the FeO in the slag. And a lance is inserted into the slag for oxygen at this time. As a result, a reaction between ZnS and $O_2$ takes place within the slag. Accordingly, the reaction of this report differs from a reaction in a production scale reaction furnace into which zinc sulfide and $O_2$ are added from above the slag bath.

SUMMARY OF THE INVENTION

Accordingly, an object of the present invention is to provide, with due consideration to the drawbacks of such conventional processes, a desulfurizing process with a high desulfurizing rate and good thermal efficiency.

A further object of the present invention is to provide a pyrometallurgical refining process which can recover metallic zinc and/or metallic lead from sulfide concentrate at low cost, without using a roasting process or sintering process for the zinc concentrate as in the ISP process.

The object of the present invention is achieved by the provision of a desulfurizing smelting process for zinc sulfide concentrates wherein a raw material, which consists mainly of zinc sulfides, and a flux are reacted with one member selected from the group of industrial oxygen, oxygen-enriched air, and air; one part of the zinc in the raw material is recovered as fume or dust which is mainly an oxidized zinc; the remainder of the zinc is recovered as a slag of molten zinc; and the molten slag is held at a temperature of 1,200° C. or greater. The sulfur content makes up 0.3 to 15 wt % of the slag including iron oxides (FeO, $Fe_3O_4$) and Silica ($SiO_2$).

In the molten slag which contains iron oxides, zinc oxides and so on formed by the desulfurizing reaction and also gangue mineral components such as $SiO_2$, the heat transfer rate and material transfer rate, particularly the oxygen transfer rate, are extremely fast and a desulfurizing rate is obtained which is larger than that obtained by roasting.

In addition, by adjusting the amount of oxygen and/or the amount of added flux supplied with respect to the raw material, the distribution ratio of the zinc fume and the slag in the raw material can be adjusted in the desulfurizing smelting process of the present invention. Then 5 to 95 wt % of zinc in the raw material can be recovered as zinc fumes and the remainder as molten slag.

In the case where the recovered zinc is mainly found in the molten slag, an oxidizing process and a reduction process are required to obtain one or both of zinc and lead from a sulfide concentrate containing at least one selected from the group comprising zinc sulfide, lead sulfide, and iron sulfide.

In the oxidation process, an iron-silicate slag or iron-silicate slag containing lime is formed in or fed into an oxidizing furnace; at least one selected from the group of industrial oxygen, oxygen-enriched air, and air, is blown into the slag containing the sulfide concentrate, the incombustible materials, and the flux, so that a reaction occurs; and, as a result, the major part of the zinc and part of the lead in the sulfide concentrate and in the incombustible materials are dissolved at a temperature of 1,150° C. to 1,300° C. in the slag comprising Fe and $SiO_2$ in an $Fe/SiO_2$ ratio of 0.70 to 1.46; CaO of 15 wt % or less; Zn in the range of 15 to 25 wt %; S in the range of 0.5 to 3 wt %; and metal and/or a matte is formed from one part of the lead in the raw material.

In the reduction process, a reducing agent such as heavy oil, pulverized coal, powdered coke, or the like is blown through the slag obtained from the oxidation process; and the zinc and the lead in the slag are volatilized then condensed to obtain molten zinc and molten lead.

BRIEF DESCRIPTION OF ACCOMPANYING DRAWINGS

These and other objects, features, and advantages of the present invention will become more apparent from the following description of the preferred embodiment taken in conjunction with the accompanying drawings, in which.

DETAILED DESCRIPTION OF THE PREFERRED EMBODIMENTS

Figure 1:
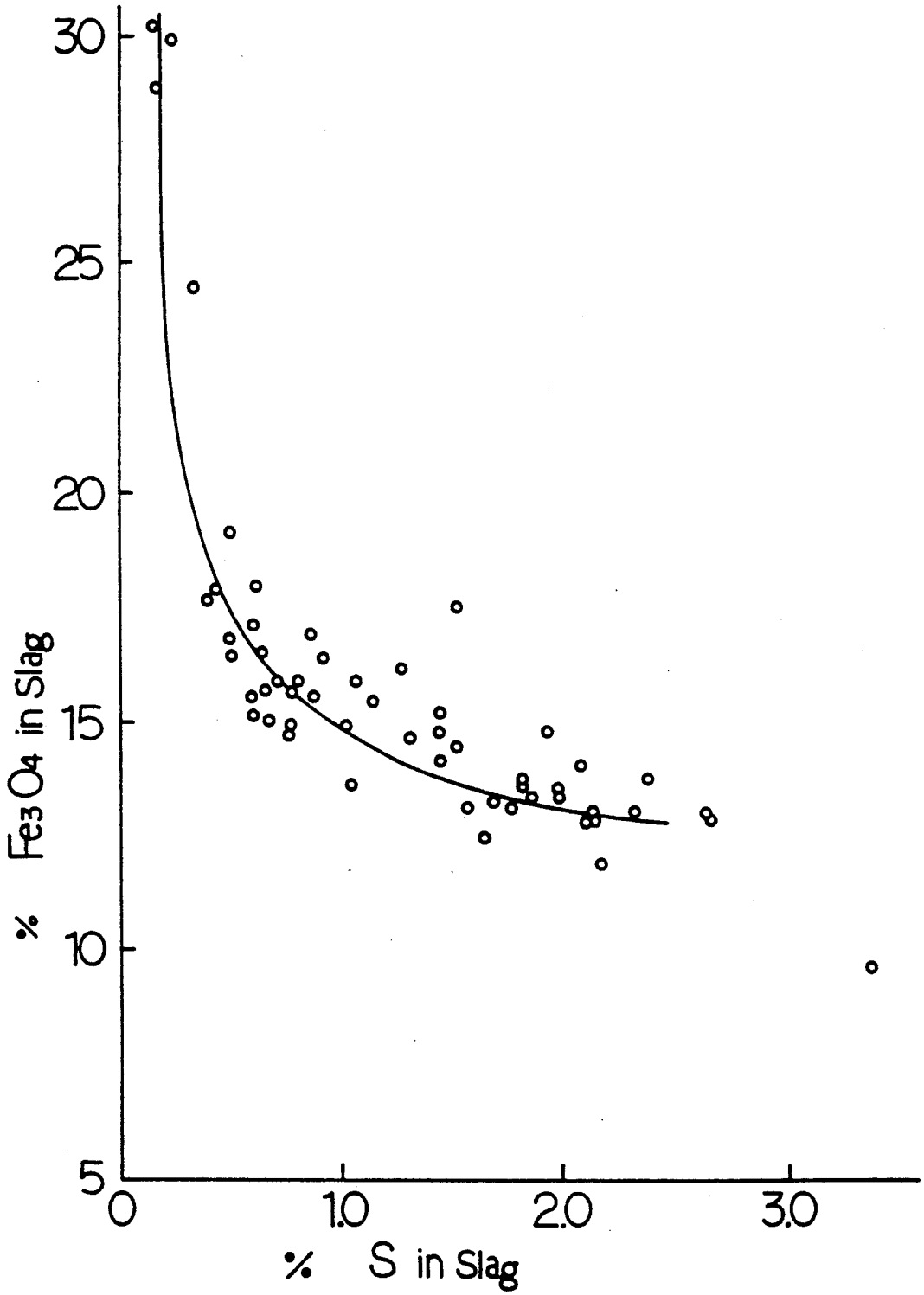
FIG. 1 is a graph showing the relationship between the contents of $Fe_3O_4$ and of S in the slag produced by the method of the present invention.

To eliminate the abovementioned problems, in the desulfurizing smelting process of the present invention, the raw material, which consists mainly of zinc sulfides, and a flux are basically reacted with any one selected from the group of industrial oxygen, oxygen-enriched air, and air; one part of the zinc in the raw material is recovered as fume which is mainly oxidized zinc; the remainder of the zinc is recovered as a slag of molten zinc; and, on recovery, the molten slag is held at a temperature of 1,200° C. or greater. The sulfur content makes up 0.3 to 15 wt % of the slag including iron oxides (FeO, $Fe_3O_4$) and Silica ($SiO_2$). If the molten slag is formed from gangue mineral components, which are oxidized materials such as iron and zinc and the like formed by the desulfurizing reaction, and also includes $SiO_2$, the heat transfer rate and material transfer rate, particularly the oxygen transfer rate, are extremely fast and a desulfurizing rate is obtained which is larger than that obtained by roasting.

In the desulfurizing smelting process of the present invention, as required, heavy oil, pulverized coal, powdered coke, or the like can be used as auxiliary fuel with the raw material and flux.

In addition, by adjusting the amount of oxygen and/or the amount of added flux supplied with respect to the raw material, the distribution ratio of the zinc fumes and the slag in the raw material can be adjusted in the desulfurizing smelting process of the present invention. Then 5 to 95 wt % of zinc in the raw material can be recovered as zinc fumes and the remainder as molten slag.

In the case where the recovered zinc is mainly found in the molten slag, an oxidizing process and a reduction process are required to obtain one or both of zinc and lead from a sulfide concentrate containing at least one selected from the group comprising zinc sulfide, lead sulfide and iron sulfide.

In the oxidation process, an iron-silicate slag or iron-silicate slag containing lime is formed in or fed into an oxidizing furnace; at least one selected from the group of industrial oxygen, oxygen-enriched air, and air, is blown into the slag containing the sulfide concentrate, the incombustible materials and flux, and a reaction occurs. As a result, the major part of the zinc and part of the lead in the sulfide concentrate and the incombustible materials are dissolved at a temperature of 1,150° C. to 1,300° C. in the slag comprising Fe and $SiO_2$ in an $Fe/SiO_2$ ratio of 0.70 to 1.46; CaO of 15 wt % or less; Zn in the range of 15 to 25 wt %; S in the range of 0.5 to 3 wt %. A metal and/or matte is formed from one part of the lead in the raw material.

In the reduction process, a reducing agent such as heavy oil, pulverized coal, powdered coke, or the like is blown through the slag obtained from the oxidation process; the zinc and the lead in the slag are volatilized then condensed to obtain molten zinc and molten lead.

In the present invention it is preferable that the valuable materials, zinc and lead, in the gas produced in the oxidation reaction be recovered in the form of incombustible materials, and these incombustible materials be returned to the oxidation process. In the reduction process, one part of the remainder of the molten slag in the reduction process is used as slag for an oxidation furnace. The slag may be solidified by cooling, after which it is pulverized and used as slag for the oxidation furnace.

Further, the raw material is prepared so that the total weight of zinc is greater than the total weight of lead in the raw material supplied to the oxidation furnace, and oxygen or oxygen-enriched air or air is blown into a matte and/or metal so that the content of sulfur is preferably decreased.

The distribution of the zinc in the fumes and slag will now be explained.

The ZnS in the raw material is reacted with oxygen, and ZnO particles and $SO_2$ are formed according to equation (1).

$$ZnS(s)+3/2O_2(g)\rightarrow ZnO(s)+SO_2(g) \quad (1)$$

The rate of this reaction is significantly accelerated at temperatures of 1,200° C. and greater. For this reason, by adjusting the degree of oxygen enrichment and/or amount of auxiliary fuel added, the reaction temperature and the temperature of the slag can be adjusted to 1,200° C. or greater.

As previously described, the molten slag of the present invention contains iron oxides and silica, and this molten slag is made up of the iron oxides formed from the iron, which makes up about 10% of the raw material, the $SiO_2$, which is the main component of the gangue, and the flux.

The molten slag is basically an $FeO-Fe_2O_3-SiO_2$ type of slag, but CaO is added as a component of the slag, as required, to lower the melting point.

The components of the molten slag will now be described.

The Fe in the concentrate generally exists as FeS, and because FeS is highly reactive it is rapidly oxidized and turned into iron oxides of various chemical forms. $Fe_3O_4$ has the highest melting point of these iron oxides and is easily separated out. When the $Fe_3O_4$ has been precipitated, the material at the bottom of the furnace is caused to rise and finally the operation is inactivated. To prevent this, it is necessary to lower the content of $Fe_3O_4$ in the molten slag as far as possible.

The results obtained from an investigation of the relationship between the contents of $Fe_3O_4$ and S in the molten slag are given in FIG. 1. In FIG. 1, the Y-axis shows the amount of $Fe_3O_4$ in the molten slag while the X-axis indicates the amount of sulfur.

As can be understood from FIG. 1, when the sulfur content is 0.3 wt % or less, the content of $Fe_3O_4$ is drastically increased. From these results it can be readily understood that it is necessary to maintain the amount of sulfur in the molten slag at 0.3 wt % or more to prevent the precipitation of the $Fe_3O_4$. In addition, the upper limit of the solubility of sulfur in the molten slag is about 15 wt %. Accordingly, the amount of sulfur contained in the molten slag of the present invention is 0.3 to 15 wt %.

The ZnO particles produced by means of the equation (1) are absorbed in the molten slag and go into solution. When the amount of oxygen reacting with the raw material is small, one part of the ZnS is decomposed according to the equation (2) below, to produce Zn vapor. This vapor is converted to ZnO particles by free air which has leaked into or been fed into the gas treatment equipment, according to the equation (3), and is recovered as fume or dust.

$$ZnS(s)\rightarrow Zn(g)+\tfrac{1}{2}S_2(g) \quad (2)$$

$$Zn(g)+\tfrac{1}{2}O_2(g)\rightarrow ZnO(s) \quad (3)$$

Accordingly, by changing the amount of oxygen supplied relative to the concentrate in the raw material, the percentage of the zinc converted to fumes can easily be regulated.

However, even when no oxygen supplied one part of the Zn vapor produced is converted to ZnS according to the reverse reaction of the equation (2) and contained in the slag, it is difficult to obtain the distribution rate of 100 wt % of the zinc to fumes.

In contrast, even if a large excess of oxygen is provided and all the ZnS in the raw material is converted to ZnO particles, it cannot be adequately absorbed in the slag, so that one part of the ZnO particles is scattered as fumes. Accordingly, it is difficult to distribute 100 wt % of the Zn into the slag. It is also obvious that it is possible to adjust the percent of the zinc distributed to the fumes by adjustment of the amount of slag.

When the present invention is applied, the question of what percentage of the Zn is distributed to the fumes is dependent on the operational configuration of the smelter which implements the molten sulfur removal process, therefore it is preferable that this configuration be selected so that the total energy cost of this smelter is a minimum.

The equipment used in an autogenous smelting method or a bath smelting method can be applied as equipment when the present invention is implemented. In the case where the method of the present invention is implemented using this type of equipment, the amount of time required to complete the reactions of equations (1) and (2) is about one second, which is considerably faster than in the case of conventional sintering equipment.

The fumes obtained by the method of the present invention can be used as it is, being fed to a briquetting process, which is the next process. In addition, the zinc in the slag obtained by the process of the present invention can be easily recovered by a normal slag fuming process. However, when it is considered that a rather high temperature is needed for this slag fuming process, the method of the present invention in which slag is obtained at a temperature of 1,200° C. or greater is extremely advantageous with respect to energy saving.

When zinc is the main product recovered from the slag, in the case where the slag fuming process is utilized, for example, after sulfide concentrate and incombustible materials (fume or dust) are dissolved in the slag through the oxidation process, the zinc and lead are volatilized and recovered as molten zinc and molten lead in the reduction process. Matte and metal produced in the oxidizing process are separated from the slag and recovered, and the incombustible materials are returned to the oxidation process.

The oxidation and reduction processes may be carried out in one furnace, or two furnaces may be used, one for each of these processes. Also, the gas used for the reaction in the oxidation process may be any of industrial oxygen, oxygen-enriched air, or air.

When Fe and $SiO_2$ contained in the raw material sulfide concentrate move into the slag, the flux addition is adjusted to obtain a slag of the target composition. However, the total volume of zinc in a normal concentrate cannot be absorbed by the amount of flux obtained in this manner. Accordingly, one part of the slag corresponding to the amount of zinc in the concentrate must be again fed into the furnace. The most suitable material as this feed slag is the slag from after the reduction volatilization of the Zn and Pb from the reducing process of the present invention. This material may be fed into the furnace directly as a solution, or may be cooled to solidify, then pulverized, and blown with the raw material in the slag. The amount of slag can be ensured by increasing the amount of flux containing the slag component.

It is advantageous to use iron-silicate slag, or iron-silicate slag containing lime in the present invention, as previously explained, because the raw material contains relatively large amounts of iron sulfide and $SiO_2$, and because it is possible to lower the melting point of the slag with CaO and to increase the rate of volatilization of Zn in the reducing process.

When the temperature of the slag is lowered, the reactivity with the slag of the concentrate which is blown into the slag is drastically lowered, and large volumes of unmelted material are produced in the furnace. On the other hand, if the temperature is too high, the larger part of not only the lead but also the zinc becomes fumes which is made up of incombustible materials which are scattered from the furnace, and the amount of fumes returned to the furnace increases, while the smelting efficiency is strikingly decreased. The temperature of the slag in the present invention, therefore, is 1,150° C. to 1,300° C.

The $Fe/SiO_2$ ratio in the slag is related to the content of magnetite in the slag and the melting point of the slag. If the $Fe/SiO_2$ ratio is less than 0.7, the content of the magnetite is lowered but the melting point of the slag is 1,300° C. or greater; if the ratio exceeds 1.46, the slag melting point is lowered but the percentage of magnetite in the slag increases and the magnetite separates out from the slag layer and accumulates on the bottom of the furnace, resulting in disadvantageously a rise of the furnace bottom.

In addition, if the CaO content exceeds 15 wt %, the melting point of the slag ends up being high, even with the $Fe/SiO_2$ ratio in the 0.70 to 1.46 range. Consequently, it is necessary to make CaO percentage decrease to 15 wt % or less. Incidentally, because the CaO exists in minute quantities in the concentrate or in the fumes, it is impossible to reduce the CaO content of the slag to zero.

However, the content of Zn in the concentrate is normally about 50 wt %. Accordingly, because the content of zinc in the slag is lowered, the amount of treated slag in the reducing furnace must be increased. The lower limit of the content of zinc in the slag becomes a production efficiency problem. A normally tolerable range is about 3 to 4 times the amount of raw material, and when this is taken into consideration, the zinc content of the slag must be 15 wt % or greater. Also, concerning the slag of the present invention, the solubility limit of the zinc is about 25 wt %, and in actual practice does not exceed 25 wt %.

Also, the reasons for the sulfur content of the slag being set in the 0.5 to 3 wt % range are as follows. If the sulfur content is less than 0.5 wt %, the amount of magnetite in the slag increases remarkably, separates out from the slag layer and solidifies on the bottom of the furnace; if greater than 3 wt %, it is possible to keep the magnetite from settling out. The sulfur is however volatized in the reduction process and becomes mixed into the gas, and when it is condensed in the condenser, it reacts with the zinc to form ZnS. This ZnS solidifies and is separated out at the inlet of the condenser, thus hingering the operation. In order to reliably avoid problems of this type, it is desirable to have a sulfur content of 1 to 2 wt %.

When a gas is blown into a raw material which contains Pb, causing a reaction to produce this type of slag, part of the lead present in the raw material becomes a matte and/or the metal. In comparison with the material obtained by the ISP process, this matte or metal is high in sulfur, and if it is subjected directly to electrolysis in this form, metallic lead cannot be obtained. For this reason, it is necessary to react the matte and/or metal with an oxidizing gas to obtain metallic lead low in sulfur enough for direct electrolytic refining. This oxidation process may also be accomplished in parallel with the oxidation of the concentrate in an oxidizing furnace, or the matte or metal is removed from the oxidizing furnace and subjected to the oxidation process in another furnace. In the case where the former oxidation process is used, the oxidizing gas must be blown directly into the matte or metal layer without coming into contact with the slag layer.

Zinc and lead and the like exist as the oxides or the sulphates or the like in the exhaust gas produced in this reaction. Therefore they must be recovered in the form of fume or dust (incombustible material). There are no particular restrictions on the equipment for effecting this recovery. A standard electrostatic precipitator or bag filter may be used. The recovered fumes or dusts generally have a high sulfur content, therefore it is unsuitable for return to the reducing furnace. It is therefore returned to the oxidizing furnace. The fumes or dusts may be mixed with the concentrate for recycling, or it may be separated from the concentrate and fed into a furnace in another system. Also, the oxidizing gas used may be industrial oxygen, oxygen-enriched air, or air.

The major part of the zinc and one part of the lead in the concentrate are mainly dissolved in the form of oxidized material in the slag produced in the oxidation process. To recover the zinc and lead from the slag, it is necessary to subject the slag to a reducing process, using a reducing agent, thus reducing and volatilizing the zinc and lead, followed by condensation. The reduction of the slag is basically the same as in the slag fuming process. Heavy oil, pulverized coal, coke, reducing gas, and the like can be used as the reducing agent. Then, as previously described, using one furnace, first the oxidation process is carried out, and after the matte or metal is removed, the remaining slag can be easily handled in the reducing process. Or, using two furnaces, the oxidation process may be carried out in one furnace, and the slag reducing process in the other.

Zinc and lead exist as metallic vapors in the exhaust gas produced from the reducing process. Therefore, it is preferable to recover the zinc and lead vapors by using the lead splash condenser used in the ISP process. The zinc and lead recovered in this manner can be processed according to the ordinal ISP process. On the other hand, one part of the slag after the reduction and volatilization are completed is either returned to the oxidation process without change, or pulverized after cooling and solidifying, and mixed with the raw material, or independently blown into the oxidizing furnace.

Normally, lead is more easily converted to fume or dust than is zinc. Accordingly, if a rather high percentage of lead is present in the raw material, the amount of fume or dust is increased, so that the quantity adhering to the waste heat boiler is large, making it difficult to operate the exhaust gas treatment equipment. To prevent this from occurring, it is preferable to ensure that the total amount of zinc charged to the oxidizing furnace is greater than the total amount of lead. It is further desirable to make the total amount of zinc twice the total amount of lead or greater.

[EXAMPLE I]

The method of the present invention is applied to a pilot smelting furnace of an autogenous smelting type.

Figure 2:
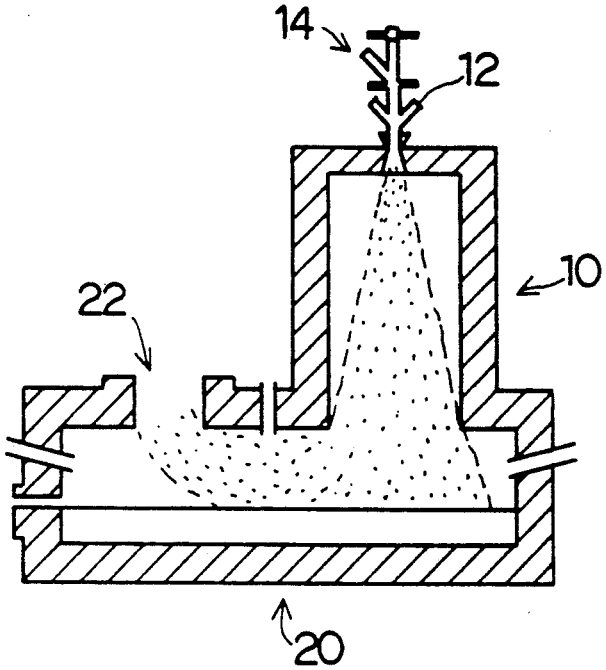
FIG. 2 is a sectional schematic view of a pilot smelting furnace used in an autogenous smelting method of an embodiment of the present invention.

The pilot smelting furnace, as shown in FIG. 2, comprises a shaft 10, four meters high, with an inner diameter of 1.5 meters, and a settler 20, 5.25 meters long, with an inner diameter of 1.5 meters. An oxygen-fuel burner 14 with a concentrate chute 12 is provided at the head of the shaft 10. One end of the settler 20 is combined with the shaft 10, and the other end of the settler 20 is provided with a smoke and soot removal channel 22.

The pilot smelting furnace of FIG. 2 was used with a raw material of the composition shown in Table 1, and test operations were carried out under the conditions given in No. I-1 and No. I-2 of Table 2. The results of these test operations are given in No. I-1 and No. I-2 respectively of Table 3. A comparison of No. I-1 and No. I-2 shows that when the total flux ratio was increased (as shown in Table 2) the zinc vaporization ratio (as shown in Table 3) decreased. Therefore, in order to have a large proportion of the zinc distributed to fumes, the total flux ratio may be reduced. The total flux ratio may be increased in order to make the distribution ratio of the zinc to fumes small.

[EXAMPLE II]

The method of the present invention is applied to a pilot smelting furnace of a bath smelting system.

Figure 3:
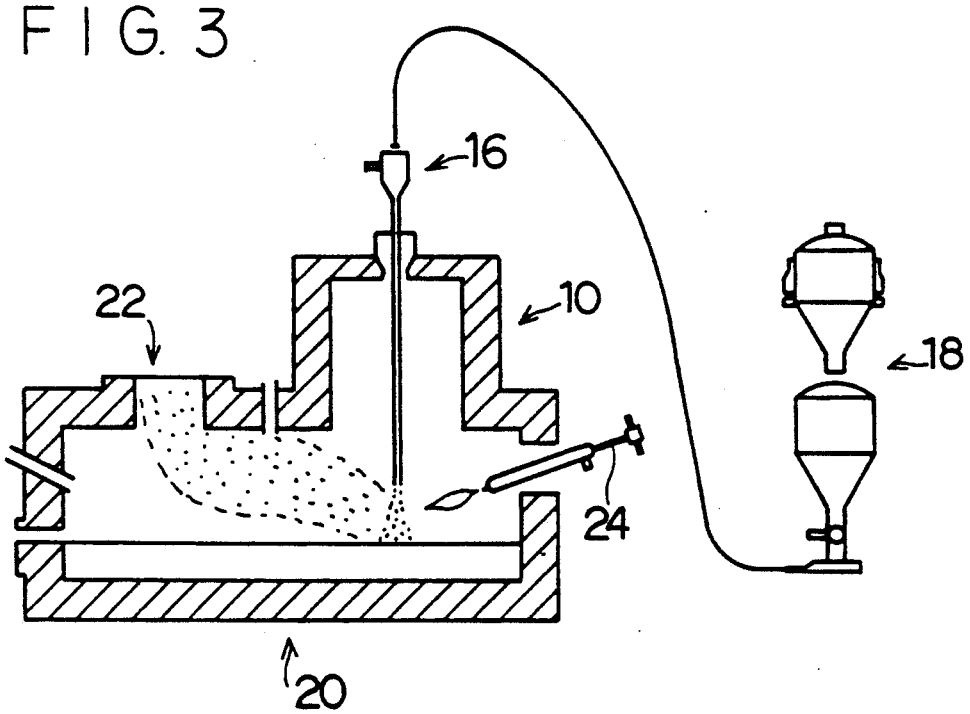
FIG. 3 is a sectional schematic view of a pilot smelting furnace used in a bath smelting method of another embodiment of the present invention.

This pilot smelting furnace, as shown in FIG. 3, has the same configuration as in the Example 1, except that in place of the oxygen-fuel burner 14 of FIG. 2, a blowing lance 16 and a blowing tank 18 are provided, an oxygen-fuel burner 24 is provided in the side wall, and the height of the shaft 10 is 2.8 meters. In this pilot smelting furnace, test operations were carried out by blowing the raw material of the composition shown in Table 1 together with air carrier and oxygen (industrial oxygen of 90% purity) into the slag layer in the furnace using the lance 16.

The conditions for the test operations are given in No. II-1 and No.II-2 of Table 2. The results of these test operations are given in No. II-1 and No. II-2 respectively of Table 3. A comparison of No. II-1 and No. II-2 in Table 3 shows that the same type of results were also obtained with bath smelting as obtained in the Example I.

[EXAMPLE III]

This test operation was carried out by blowing the raw material of the composition shown in Table 1, together with air carrier, into the slag layer in the furnace using the lance 16 under the conditions given in No. III-1 of Table 2, and using the same pilot smelting furnace as in the Example II. In this test, one part of the FeS in the Zn concentrate was oxidized by feeding only the oxygen in the air for the necessary oxidation. From the conditions, almost all the ZnS would have been decomposed according to reaction (2). The results given in No. III-1 of Table 3 are the average results obtained over a three-day period.

From the results given in No. III-1 of Table 3, the sulfur made up 12.9 wt % of the slag, and in spot samples, results as high as 15.0 wt % sulfur were obtained. The zinc showed a high volatilization ratio of 71.8%.

From these results, it can be understood that the amount of oxygen used in the reaction was limited, and the total flux ratio was low in order to recover the zinc as dust or fume.

[EXAMPLE IV]

This test operation was carried out under the same conditions as in the Example III, except that 400 $Nm^3/hr$ of air were blown onto the slag surface in the settler 20. The conditions for the test operations are given in No. IV-1 of Table 2 and the results are given in No. IV-1 of Table 3. From the results for No. IV-1 of Table 3 it can be understood that the content of sulfur in the slag was low, and the zinc was removed from the slag by volatilization so that the content of zinc in the slag was also low. The volatilization ratio of the zinc and the ratio of the fume or dust produced are seen to be even greater than the values in No. III-1. This is because the air was blown onto the surface of the slag so that the amount of oxygen which reacted with the zinc at the surface of the slag was increased.

Accordingly, it is possible to adjust the ratio of the zinc distributed to fume or dust by increasing or decreasing the amount of oxygen.

[EXAMPLE V]

Figure 4:
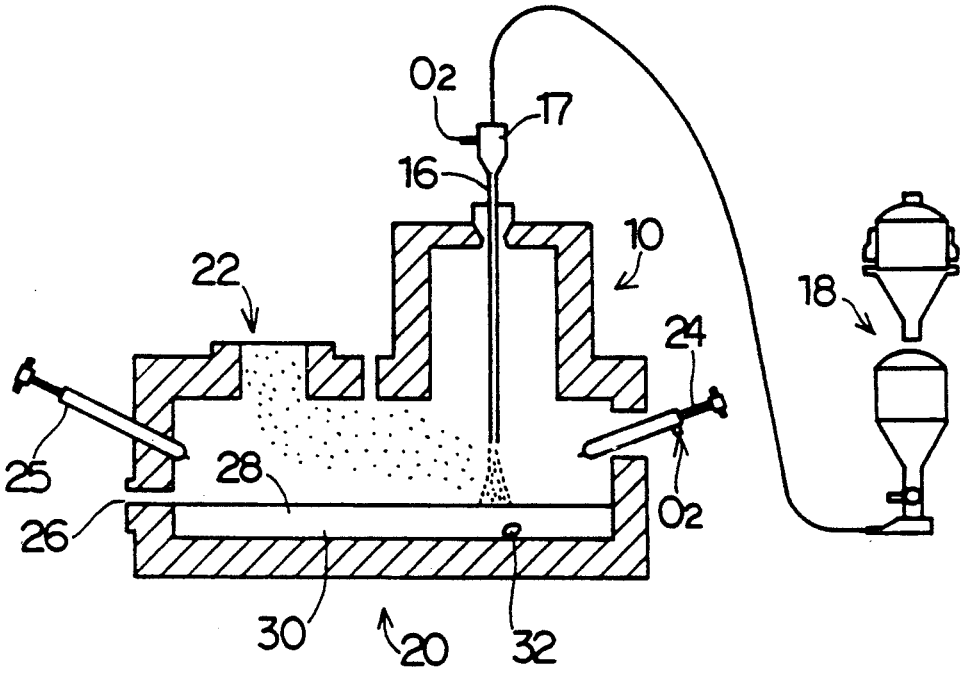
FIG. 4 is a sectional schematic view of a pilot smelting furnace used in another embodiment of the present invention.

The pilot smelting furnace shown in FIG. 4 is provided with a reaction shaft 10, 2.8 meters high and an inner diameter of 1.5 meters, and a settler 20, 5.25 meters long, with an inner diameter of 1.5 meters. One end of the settler 20 is combined with the reaction shaft 10, and the other end of the settler 20 is provided with a smoke and soot removal channel 22.

A first blowing lance 16, 2.5 cm in diameter, is inserted into the upper section of the reaction tower 10. An oxygen-raw material mixing apparatus 17 which mixes oxygen with the raw material is connected to the first lance 16, and a raw material airveying device 18 is connected to the oxygen-raw material mixing apparatus 17.

An oxygen-heavy oil burner 24 and a heat-maintaining heavy-oil burner 25 are provided at the opposing side wall of the settler 20.

A slag hole 26 is provided beneath the heat-maintaining heavy-oil burner 25, positioned so that slag 28 can run out.

A tap-hole 32 for withdrawing a matte and/or a metal 30 accumulated under the slag 28 is provided in one part of a side wall of the settler 20.

The pilot smelting furnace of FIG. 4 was used with a raw material of the composition shown in Table 4, and tests No. V-1 to No. V-11 were carried out under the conditions given in Table 5. Initially the test was performed in the same manner as in an ordinal autogenous smelting furnace. The charge raw material was adjusted according to the various specified conditions, auxiliary fuel, and oxygen-enriched air were blown into the reaction shaft 10 from the top portion of the reaction shaft, and molten slag was produced.

Then, the 2.5 cm-diameter first blowing lance 16 provided at the upper section of the reaction shaft 10, so that the blowing port is positioned 30 cm from the surface of the slag was operated to blow the charge raw material together with oxygen-enriched air containing 70% oxygen by volume into the slag. Compensation for the heat required to melt the concentrate and the heat loss from the settler 20 and the like was provided using the heat-maintaining heavy-oil burner 25 mounted on the side wall of the settler 20. Further, the 70% oxygen by volume oxygen-enriched air was used as the reaction air for combustion of the heavy-oil burner 24 at the side of the reaction shaft, and ambient air was used for the heavy-oil burner 25 at the side of the slag hole.

In addition, for the charge material, the concentrates, fume or dust, and flux in Table 4 were dried together, then mixed and adjusted according to Table 5. When the adjusted ratios were decided, the amount of concentrate to be treated was set at 300 Kg/hr and the amounts of fume or dust, flux, heavy oil, and oxygen were adjusted to make it possible to carry out the target operation.

The produced slag was generally withdrawn every four hours through the slag hole 26 shown in FIG. 4, into a ladle. A temperature measurement was made and a sample taken for fluorescence X-ray analysis from the first half and from the last half of the withdrawn material. The matte and/or the metal was withdrawn from the tap-hole 32 whenever possible. About 0.5 tons was withdrawn on each occasion, and a sample taken for analysis at the same time. The presence of the matte and/or the metal was confirmed by inserting a measuring rod into the liquid through a measurement hole provided in the cover of the settler, withdrawing the rod, and observing the condition of the liquid adhering to the rod.

The results are shown in Table 6. All products were withdrawn intermittently, but the slag was withdrawn at comparatively short intervals of 3 to 4 hours, and the amount withdrawn on each occasion was rather large at 1.6 to 2.0 tons, so that the results were reliable.

TABLE 1

| | Composition (%) | | | | | |
|---|---|---|---|---|---|---|
| Material | Zn | Pb | S | Fe | $SiO_2$ | REST |
| Concentrate A | 51.4 | 1.4 | 30.2 | 11.0 | 1.9 | 4.1 |
| Concentrate B | 50.8 | 1.3 | 30.5 | 11.6 | 1.9 | 3.9 |
| Slag Tailings | 2.7 | 2.7 | 0.1 | 44.8 | 22.2 | 27.5 |
| Granulated Slag | 1.9 | 0.4 | 0.8 | 36.6 | 27.0 | 33.3 |
| Silica | 0 | 0 | 0 | 1.2 | 91.7 | 7.1 |

TABLE 2

| | Zn Concentrate A | | Zn Concentrate B | | Zn Concentrate A | |
|---|---|---|---|---|---|---|
| Test Condition | No. I-1 | No. I-2 | No. II-1 | No. II-2 | No. III-1 | No. IV-1 |
| Zn Concentrate Kg/h | 431 | 319 | 387 | 269 | 282 | 303 |
| Granulated Slag % | 0 | 0 | 90 | 133 | 0 | 0 |
| Slag Tailings % | 75 | 136 | 0 | 0 | 0 | 0 |
| Silica % | 19 | 27 | 0 | 23 | 6 | 9 |
| Total Flux % | 94 | 163 | 90 | 156 | 6 | 9 |
| Heavy Oil (Burner) l/h | 19 | 37 | 0 | 0 | 0 | 0 |
| Oxygen (90% purity) $Nm^3/h$ | 146 | 166 | 54.9 | 52.5 | 0 | 0 |
| Air Carrier $Nm^3/h$ | 0 | 0 | 54.5 | 55.5 | 55.6 | 54.5 |
| Heavy Oil (Settler) l/h | 40 | 40 | 49 | 63 | 49 | 49 |
| Oxidizing Air $Nm^3/h$ | 0 | 0 | 0 | 0 | 0 | 400 |

TABLE 3

| | No. I-1 | No. I-2 | No. II-1 | No. II-2 | No. III-1 | No. IV-1 |
|---|---|---|---|---|---|---|
| Slag Composition % | | | | | | |
| Zn | 22.2 | 19.4 | 22.4 | 20.5 | 31.2 | 27.5 |
| S | 1.9 | 0.6 | 5.0 | 1.9 | 12.9 | 6.3 |
| Fe | 29.8 | 31.8 | 28.9 | 25.9 | 23.8 | 24.6 |
| $SiO_2$ | 23.9 | 25.0 | 17.0 | 25.2 | 15.9 | 22.4 |
| $Fe_3O_4$ | 13.0 | 15.0 | 7.1 | 7.9 | 5.9 | 7.1 |
| Slag Temperature °C. | 1302 | 1329 | 1287 | 1285 | 1314 | 1279 |

TABLE 3-continued

| | No. I-1 | No. I-2 | No. II-1 | No. II-2 | No. III-1 | No. IV-1 |
|---|---|---|---|---|---|---|
| Dust Generation % | 20.7 | 12.1 | 15.2 | 3.8 | 48.3 | 49.7 |
| Zn Vaporization % | 37.4 | 20.2 | 34.5 | 10.3 | 71.8 | 75.8 |

TABLE 4

| | | (Materials) Composition (Wt %) | | | | | |
|---|---|---|---|---|---|---|---|
| | | Zn | Pb | S | Fe | Cao | $SiO_2$ |
| Concentrate | A | 32.2 | 12.5 | 27.6 | 13.3 | 0.8 | 4.7 |
| | B | 51.4 | 1.4 | 30.2 | 11.0 | 0.3 | 1.9 |
| Dust | A | 1.9 | 64.0 | 9.8 | 1.4 | — | 0.6 |
| | B | 53.6 | 8.8 | 3.2 | 5.8 | 1.4 | 4.8 |
| | C | 36.7 | 27.1 | 5.5 | 3.4 | 0.8 | 3.7 |
| Flux | A | 1.8 | 0.5 | 0.6 | 35.4 | 2.4 | 26.0 |
| | B | 2.7 | 2.7 | 0.1 | 44.8 | 2.2 | 22.2 |
| | C | 2.6 | 0.1 | 0.5 | 26.7 | 6.8 | 32.8 |
| | D | — | — | — | 1.2 | 1.5 | 91.7 |
| | E | — | — | — | — | 55.2 | — |

The fumes or dusts were collected continuously in a dust chamber and an electrostatic precipitator, and were weighed on a daily basis. There was, therefore, no problem in accurately determining the amount of dust.

However, the matte could not be withdrawn before an amount of accumulation was made and could not be completely discharged. The measurement accuracy was, therefore, not good.

The metal could not be withdrawn separately from the matte so, after the material adhering to the measuring rod and the matte had solidified, the bottom of the ladle was examined and judged for the presence or absence of metal.

Each test shown in the following Tables 5 and 6 will now be explained by Test Number.

TABLE 5

| | (Materials) Concentrate Kg/h | | Dust Kg/h | | | Flux Kg/h | | | | | Heavy Oil l/h | | Oxygen-enriched air $Nm^3/h$ | |
|---|---|---|---|---|---|---|---|---|---|---|---|---|---|---|
| No. | A | B | A | B | C | A | B | C | D | E | Shaft Side | Slag Hole Side | for Concentrate | for Shaft Side Heavy Oil |
| V-1 | 289 | | | | | 151 | | | 53 | 28 | 16 | 20 | 98 | 45 |
| V-2 | 306 | | | | | 127 | | | 51 | | 14 | 20 | 98 | 38 |
| V-3 | 292 | | | | | 159 | | | 54 | 115 | 28 | 20 | 87 | 78 |
| V-4 | 309 | | | | | 118 | | | 78 | 95 | 32 | 20 | 85 | 87 |
| V-5 | 301 | | | | | 134 | | | 84 | | 13 | 20 | 109 | 35 |
| V-6 | | 295 | 103 | | | 241 | | | 55 | 51 | 34 | 20 | 88 | 93 |
| V-7 | | 311 | 92 | | | 202 | | | 66 | | 24 | 20 | 104 | 66 |
| V-8 | | 308 | | | | | 369 | | 84 | 71 | 42 | 20 | 92 | 115 |
| V-9 | | 305 | | | | | 379 | | 54 | 62 | 40 | 20 | 102 | 109 |
| V-10 | | 290 | | 97 | | | 415 | | 164 | 90 | 61 | 20 | 73 | 168 |
| V-11 | 295 | | | | 106 | | | 217 | 38 | 44 | 29 | 20 | 88 | 81 |

TABLE 6

| | (Products) Slag | | | | | | | | Matte | | | Dust | | | | Metal |
|---|---|---|---|---|---|---|---|---|---|---|---|---|---|---|---|---|
| | Wt. | Temp. | Composition (wt %) | | | | | | Wt. | Comp. (Wt %) | | Wt. | Composition (wt %) | | | Genera- |
| No. | kg/h | °C. | Zn | Pb | S | $Fe/SiO_2$ | CaO | $Fe_3O_4$ | kg/h | Pb | S | kg/h | Zn | Pb | S | tion |
| V-1 | 430 | 1248 | 20.0 | 3.6 | 1.8 | 0.91 | 5.1 | 9.1 | 80 | 15.8 | 23.7 | 25 | 36.7 | 27.1 | 5.5 | NO |
| V-2 | 400 | 1258 | 21.1 | 5.1 | 2.6 | 0.92 | 1.5 | 5.1 | 30 | 17.1 | 22.4 | 43 | 38.4 | 28.6 | 5.7 | NO |
| V-3 | 460 | 1179 | 15.0 | 0.4 | 2.2 | 0.92 | 15.2 | 14.0 | 50 | 21.9 | 20.6 | 72 | 38.9 | 29.4 | 5.9 | YES |
| V-4 | 430 | 1302 | 15.0 | 0.4 | 2.9 | 0.72 | 13.5 | 11.5 | 40 | 18.5 | 21.8 | 94 | 39.2 | 29.6 | 5.9 | NO |
| V-5 | 440 | 1273 | 19.6 | 4.9 | 0.9 | 0.70 | 1.5 | 7.7 | 40 | 13.6 | 23.1 | 34 | 37.3 | 27.5 | 5.5 | NO |
| V-6 | 520 | 1167 | 19.0 | 3.3 | 1.1 | 1.00 | 6.8 | 12.3 | 10 | 16.3 | 23.3 | 159 | 37.1 | 33.1 | 6.4 | YES |
| V-7 | 520 | 1261 | 25.1 | 5.1 | 1.6 | 0.90 | 1.3 | 7.0 | 60 | 17.3 | 21.6 | 84 | 39.4 | 30.0 | 6.0 | YES |
| V-8 | 720 | 1255 | 20.3 | 1.5 | 2.8 | 1.21 | 6.8 | 10.8 | 0 | — | — | 42 | 53.6 | 8.8 | 3.2 | NO |
| V-9 | 650 | 1296 | 18.3 | 1.0 | 1.1 | 1.46 | 6.7 | 16.4 | 0 | — | — | 81 | 59.1 | 10.2 | 3.6 | NO |
| V-10 | 930 | 1251 | 20.4 | 2.1 | 2.7 | 0.89 | 6.8 | 8.7 | 0 | — | — | 43 | 52.8 | 11.5 | 3.6 | NO |
| V-11 | 550 | 1244 | 22.6 | 2.6 | 1.8 | 0.82 | 7.7 | 10.5 | 210 | 15.4 | 22.7 | 43 | 34.3 | 31.0 | 6.0 | YES |

TABLE 7

| | | Composition (wt %) | | | | | | |
|---|---|---|---|---|---|---|---|---|
| | | Zn | Pb | S | Fe | CaO | $SiO_2$ | C |
| Zn Slag | 406 kg/h | 20.0 | 3.6 | 1.8 | 21.1 | 5.1 | 23.2 | 0 |
| Coke Powder | 269 kg/h | 0 | 0 | 1.1 | 0.8 | 0.8 | 5.3 | 85.4 |
| Industrial Oxygen | 248 $Nm^3/h$ | | | | | | | |
| Air | 194 $Nm^3/h$ | | | | | | | |
| Slag | 320 Kg/h | 2.6 | 0.1 | 0.5 | 26.7 | 6.8 | 32.8 | — |
| Dust | 124 Kg/h | 58.5 | 12.9 | 0.2 | 1.5 | 0.4 | 2.1 | 9.0 |
| Metal | — | 1.1 | 80.0 | 0.5 | — | — | — | — |

[EXAMPLE V-1]

For the Example V-1 the operation was performed with adjustments made to obtain a slag temperature of 1,250° C., a sulfur content of 1.5%, and Fe/SiO ratio of 0.9, a CaO content of 5 wt %, and a zinc content of 20 wt %, and a slag was obtained which generally met the target. Small amounts of matte and dust were obtained but the formation of metal could not be confirmed in the performance of the Example V-1.

[EXAMPLE V-2]

This Example was carried out to reduce the CaO content in the slag obtained in the Example V-1, and the addition of the flux E was omitted. The target amount of the flux A was reduced and the amount of the concentrate A was slightly increased. As a result, the temperature of the slag was increased by 10° C. and the sulfur content was 2.6 wt %. Then, because the flux A originally contained 2.4 wt % CaO, the amount of CaO in the slag only dropped to 1.5 wt %. From this result it could be understood that, essentially, it is also possible to process the concentrate without CaO. Also, from the overall viewpoint, the Example V-2 was almost identical to the Example V-1, judging from the operating results obtained.

[EXAMPLE V-3]

This Example was carried out with the CaO content increased to 15 wt %, and as a result of the higher CaO content the melting point of the slag was expected to decrease. The target slag temperature decreased from 1,250° C. to 1,180° C. During the operation, a greater amount of the flux E was added, so that the amount of heavy oil fuel consumed in the heavy oil burner in the reaction shaft increased to 28 l/hr.

There were no obstacles in the discharge of the slag, but the contents of zinc and lead in the slag were reduced, and the content of magnetite increased. For this reason, a semi-molten material rich in magnetite was created between the slag and the matte. In addition, the amount of zinc in the slag reached 15.0 wt %. In this test, the production of metallic lead was confirmed.

When the CaO content was increased to 20 wt % the content of magnetite further increased about 3 wt %, the melting point of the slag increased, and part of the slag solidified, reducing the size of the powering basin in the settler. In addition, the discharge action became difficult because when the slag was withdrawn it became heaped up in the flume. The CaO content must therefore be less than 15 wt %.

[EXAMPLE V-4]

This test was carried out with the object of eliminating the semi-molten material, with the CaO content of the slag about 15 wt %. Specifically, the amount of the flux A was reduced and the amount of flux D increased, and the $Fe/SiO_2$ ratio was lowered from 0.9 to 0.7. It was expected that by lowering the $Fe/SiO_2$ ratio a considerable increase in the melting point of the slag would result, and the target slag temperature was set at 1,300° C.

As a result, the semi-molten material disappeared and the amount of magnetite in the slag was reduced by 2.5 wt %. However, the zinc in the slag remained the same at 15 wt % and the major part of the lead in the raw material became dusts or fumes. In this way it can be understood that when the $Fe/SiO_2$ ratio is 0.7 or less the temperature of the slag must be high, and because of this, the zinc and lead are easily volatilized. This trend is more pronounced with a high CaO content. Accordingly, the $Fe/SiO_2$ ratio must be 0.7 or greater.

[EXAMPLE V-5]

Next, in order to carry out the operation with a low CaO content, the addition of the flux E was terminated, the $Fe/SiO_2$ ratio was set at 0.7 and the operation proceeded. In this test, in spite of the fact that the slag temperature was high at 1,273° C., both the zinc and the lead were readily absorbed in the slag to a content of 19.6 wt % and 4.9 wt % respectively. As a result, the dust was greatly reduced. Since the lime content was low, the magnetite content was low. In spite of the fact that the bottom of the furnace was observed to rise to some extent. Accordingly, for a continuous, stable operation under these conditions, it is necessary to have a slag temperature of 1,300° C. or higher. It is apparent that the Example V-5 of the present invention is not practical. Therefore, from this consideration also, the $Fe/SiO_2$ ratio must be 0.7 or greater.

[EXAMPLE V-6]

In this test the concentrate B featuring a low Pb content, was used in place of the concentrate A. The target for the slag temperature was 1,170° C. Although the semi-molten material formed between the slag and the matte built up at the bottom of the furnace the slag was withdrawn without any problem. However, because the temperature of the slag was low at 1,167° C., the combustibility of the concentrate was slightly worsened and a small quantity of unmelted mass was confirmed on the slag. This, however, did not adversely affect the operation. After the matte was withdrawn and had solidified in the ladle, it was removed from the ladle and the presence of metal was confirmed.

Under these conditions, when the temperature of the slag dropped below 1,145° C. a large amount of unmelted material was detected under the blowing lance. Accordingly, the slag temperature must be 1,150° C. or greater.

[EXAMPLE V-7]

This Example was a continuation of the Example V-6. After the slag temperature dropped below 1,145° C. and the unmelted material was detected, as previously described, the introduction of the flux E was terminated. When the slag temperature rose to about 1,260° C., the semi-molten material and the unmelted material all disappeared. Metal was formed along with the matte in this test, but the amount of dust or fume was reduced. A zinc content of 25.1 wt % was obtained in the slag, but this was the maximum zinc content obtained in one series of test operations. Accordingly, it was expected that the upper limit of the zinc in the slag is 25 wt %.

[EXAMPLE V-8]

To reduce the Pb load still further, the feeding of the dust A was halted and the flux B was used in place of the flux A. This reduced the Pb load, and by further increasing the flux charge the zinc in the slag was greatly reduced. However, there was no elevation of the bottom of the furnace and no change occurred in the slag withdrawal characteristics.

The amount of lead contained in the raw material in this test was small, therefore there was no matte or metal produced. Accordingly, it can be understood that under special conditions of raw material only slag will exist in the furnace. In general, however, the fume or dust containing the lead produced in the oxidation process is returned to the oxidation process, so it is uncommon for the liquid in the furnace to be only slag.

In the last part of this test the amount of oxygen-enriched air for the concentrate was increased. When the sulfur content of the slag was gradually lowered, at 0.4 wt % sulfur the content of magnetite in the slag reached 18.3 wt % and a large amount of semi-molten material was produced and the bottom of the furnace was observed to abruptly rise. This indicates that the content of sulfur in the slag must be 0.5 wt % or greater.

[EXAMPLE V-9]

The same type of raw material was used in this test as in the Example V-8, the amount of sulfur in the slag was maintained at about 1 wt %, and the $Fe/SiO_2$ ratio was 1.5. When the sulfur content was 1.1 wt % and the $Fe/SiO_2$ ratio was 1.46, the content of magnetite was 16.4 wt % and the same phenomena were observed as when the sulfur content was 0.4 wt %. This indicates that the $Fe/SiO_2$ ratio must be 1.46 or less.

[EXAMPLE V-10]

In this Example, the dust B produced in the Example V-8 was introduced, and the test operations were carried out using the concentrate B and the fluxes B, D, and E. With the content of sulfur in the slag at 2.7 wt % and the $Fe/SiO_2$ ratio 0.89, it was possible to operate in the same manner as for the Example V-8. It could therefore be understood that it is possible to process fume or dust containing oxidized material and sulfates.

[EXAMPLE V-11]

In this Example, the concentrate A, the dust C produced in the Example V-1, a slag produced after the completion of a later-described reduction test (the flux C), and the fluxes D and E were processed together. It could be understood from Table 6 that no operational problems occurred when using both the dust C and the flux C. Accordingly, it was possible to return the major part of the slag after reduction and volatilization to the oxidation process. In this Example, the slag after reduction and volatilization was solidified and pulverized before being used, but it can be assumed that energy costs could be greatly reduced if this material were recycled in the molten state.

[EXAMPLE VI-1]

Figure 5:
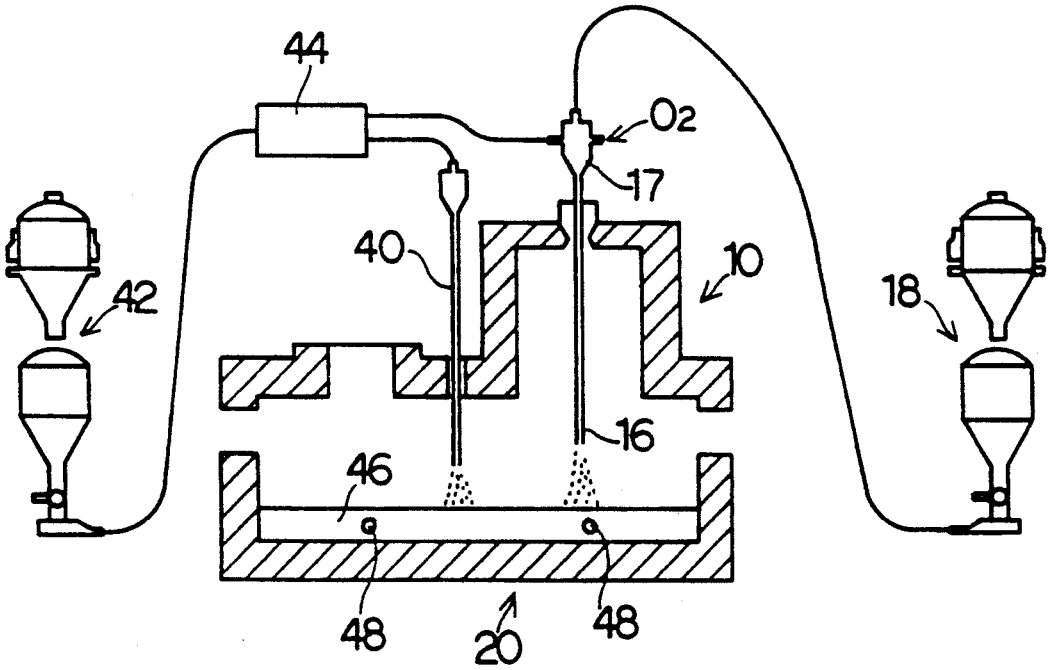
FIG. 5 is a sectional schematic view of a pilot smelting furnace used in yet another embodiment of the present invention.

The pilot smelting furnace shown in FIG. 5 is provided with a second lance 40 for blowing powdered coke into the center of the upper section of the settler 20 for the pilot smelting furnace shown in FIG. 4.

A coke airveying device 42 for handling the powdered coke which is used for reducing the slag as well as for maintaining the target temperature in the furnace is connected to the first lance 16 and the second lance 40 through a distributor 44. A slag hole 48 for allowing the slag 46 to run out is provided in a section of the side wall of the settler 20. A heavy oil burner is not provided for the pilot smelting furnace of FIG. 5.

The pilot smelting furnace of FIG. 5 has a shape suitable for accommodating the second lance 40 for blowing powdered coke into the center section of one part of the settler for the furnace used in the Example V-1. The slag obtained in the Example V-1 was solidified, pulverized, and a specified amount of slag powder was charged into the raw material airveying device 18, conveyed using air, and blown into the lower section of the reaction shaft 10. The powdered coke for reducing the slag and maintaining the target value of the temperature in the furnace was charged into the powdered coke airveying device (injection tank) 42 and airveyed through the distributor 44 to the first lance 16, and the major part of the powdered coke was blown into the bottom of the reaction shaft with the slag powder.

The rest of the powdered coke was blown into the settler 20 from the second lance 40. Industrial oxygen was then fed into the furnace together with the slag powder and the powdered coke by the first lance 16 provided in the reaction shaft 10.

The slag temperature in the furnace was maintained at 1,300° C., the $CO_2/CO$ ratio in the exhaust gas adjusted to 0.5, and the test operated for 24 hours. The reduced and volatilized zinc and lead were suitably blown with air and caused to react in the exhaust gas processing equipment, so that then ZnO and PbO are recovered. In addition the CO in the gas was converted to $CO_2$ and rendered non-toxic. The results obtained under these operating conditions are shown in Table 7.

From Table 7 it can be understood that it is possible to reduce and volatilize the zinc and lead from the slag obtained from the oxidizing furnace. Accordingly, it is clearly shown that zinc and lead can be recovered as metals by use of the condenser used in the ISP process.

In the process of the present invention as mentioned above, oxidized materials such as iron, zinc, and the like which are produced in a desulfurizing reaction together with gangue mineral components such as $SiO_2$ and the like, are formed into a molten slag, and the raw material is blown into the molten slag the desulfurizing rate is extremely fast. Also, the temperature of the materials produced is high, so that the heat from the desulfurizing reaction can be effectively utilized in a reducing process. It is also possible to distribute the zinc in an optional ratio between dust and slag in the exidation process. Furthermore, the roasting and sintering processes for refining the zinc, which are essential in the conventional ISP process, can be eliminated, the zinc and lead can both be recovered as metal at the same time, and low-priced powdered coke can be used as a reducing agent.

What is claimed is:

1. A desulfurizing smelting process for refining a zinc sulfide-containing concentrate, said process comprising the successive steps of:

providing a raw material which consists mainly of zinc sulfide;

introducing said raw material, a flux, and an oxidizing gas selected from the group consisting of industrial oxygen, oxygen-enriched air and air, into a furnace and subjecting said raw material to a desulfurization reaction in the presence of said flux, whereby one portion of the zinc in said raw material is converted to dust or fumes of oxidized zinc and another portion of the zinc in said raw material is dissolved in a molten slag in said furnace, wherein said slag contains iron oxides, silica and from 0.3 to 15 wt % sulfur and is maintained at a temperature of at least 1,150° C.;

regulating the distribution of zinc from said raw material between said dust or fumes and said molten slag by controlling the amount of oxygen, the amount of flux, or both the amount of oxygen and the amount of flux introduced with the raw material;

collecting said dust or fumes of oxidized zinc; and recovering said zinc-containing molten slag.

2. A process according to claim 1, wherein at least one reducing agent selected from the group consisting of heavy oil, pulverized coal and coke, is introduced into said furnace with said raw material and said flux.

3. A process according to claim 1, wherein the distribution of zinc from said raw material between said dust or fumes and said molten slag is regulated by controlling the amount of oxygen introduced with the raw material.

4. A process according to claim 1, wherein the distribution of zinc from said raw material between said dust or fumes and said molten slag is regulated by controlling the amount of flux introduced with the raw material.

5. A process according to claim 1, wherein the distribution of zinc from said raw material between said dust or fumes and said molten slag is regulated by controlling the amount of oxygen and the amount of flux introduced with the raw material.

6. A pyrometallurgical refining process for recovering zinc from a zinc sulfide-containing concentrate, said process comprising:

a) an initial oxidation stage comprising the steps of:

a1) providing an iron-silicate slag in an oxidizing furnace;

a2) introducing said zinc sulfide-containing concentrate, a flux and an oxidizing agent selected from the group consisting of industrial oxygen, oxygen-enriched air and air, into said slag and subjecting said zinc sulfide-containing concentrate to a desulfurization reaction, whereby the major portion of the zinc from said concentrate is dissolved in said slag;

wherein said slag is maintained at a temperature in the range from 1,150° C. to 1,300° C. and contains Fe and $SiO_2$ in an $Fe/SiO_2$ ratio of from 0.70 to 1.46, 0 to 15 wt % CaO, 15 to 25 wt % Zn, and 0.5 to 3 wt % S; and b) after completion of said oxidation stage, a subsequent reduction stage comprising:

b1) introducing a reducing agent through the slag obtained in said oxidation stage, whereby zinc from said slag is volatilized, and b2) condensing said volatilized zinc to obtain molten zinc.

7. A process according to claim 6, wherein said concentrate further contains lead sulfide, and part of the lead therefrom is dissolved in said slag.

8. A process according to claim 7, wherein another part of the lead forms a matte or molten metal layer.

9. A process according to claim 7, wherein lead is also volatilized in said reduction stage and condensed to obtain molten lead.

10. A process according to claim 6, wherein said concentrate also contains iron sulfide.

11. A process according to claim 6, wherein said slag contains lime.

12. A process according to claim 6, wherein incombustible materials emitted from said oxidizing furnace as dust or fumes containing at least one metal selected from the group consisting of zinc and lead are collected and reintroduced into said oxidizing furnace.

13. A process according to claim 6, wherein a portion of the slag remaining after step b1) of said reduction stage is introduced into said oxidation stage for use as the slag for step a1).

14. A process according to claim 13, wherein said slag remaining after step b1) of said reduction stage is cooled and solidified and then pulverized before introduction into said oxidation stage.

15. A process according to claim 6, wherein a portion of the slag remaining after step b1) of said reduction stage is introduced into said oxidation stage for use as the flux for step a2).

16. A process according to claim 7, wherein the total weight of zinc contained in said concentrate introduced into said oxidation stage is greater than the total weight of lead contained in said concentrate.

17. A process according to claim 8, wherein said matte or molten metal layer contains sulfur, further comprising the step of blowing an oxidizing gas into said matte or molten metal layer to decrease the sulfur content thereof.

18. A process according to claim 17, wherein said oxidizing gas is air.

19. A process according to claim 6, wherein said reducing agent is selected from the group consisting of heavy oil, pulverized coal and powdered coke.

20. A process according to claim 6, wherein incombustible materials containing at least one metal selected from the group consisting of zinc and lead emitted from said oxidizing furnace as dust or fumes are collected and reintroduced into said oxidizing furnace, and a portion of the slag remaining after step b1) of said reduction stage is introduced into said oxidation stage for use as the slag for step a1).

21. A process according to claim 20, wherein said slag remaining after step b1) of said reduction stage is cooled and solidified and then pulverized before introduction into said oxidation stage.

22. A process according to claim 6, wherein incombustible materials containing at least one metal selected from the group consisting of zinc and lead emitted from said oxidizing furnace as dust or fumes are collected and reintroduced into said oxidizing furnace, and a portion of the slag remaining after step b1) of said reduction stage is introduced into said oxidation stage for use as the flux for step a2).

23. A process according to claim 6, wherein said reduction stage is subsequently carried out in a different furnace from that used for the oxidation stage.

24. A process according to claim 6, wherein said reduction stage is subsequently carried out in the same furnace zone as the oxidation stage.

25. A process according to claim 6, wherein said slag providing step a1) is effected by supplying the furnace with an iron-silicate slag from outside the furnace.

26. A process according to claim 6, wherein said slag providing step a1) is effected by forming an iron-silicate slag in situ in the furnace.

* * * * *